US008671476B2

(12) United States Patent
Stewart et al.

(10) Patent No.: US 8,671,476 B2
(45) Date of Patent: Mar. 18, 2014

(54) WOVEN CONTOURED BED SHEET WITH ELASTOMERIC YARNS

(75) Inventors: Richard Stewart, Mason, OH (US); Saravan Muthanandam, Loveland, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 1483 days.

(21) Appl. No.: 12/025,975

(22) Filed: Feb. 5, 2008

(65) Prior Publication Data

US 2009/0193584 A1 Aug. 6, 2009

(51) Int. Cl.
*A47G 9/04* (2006.01)

(52) U.S. Cl.
USPC ..... 5/482; 5/497

(58) Field of Classification Search
USPC ..... 5/497–499, 482
See application file for complete search history.

(56) References Cited

U.S. PATENT DOCUMENTS

| | | | | |
|---|---|---|---|---|
| 3,145,132 | A | 8/1961 | Seltzer | |
| 3,290,702 | A * | 12/1966 | Seltzer | 5/497 |
| 4,504,990 | A | 3/1985 | Scales et al. | |
| 5,495,874 | A | 3/1996 | Heiman | |
| 6,199,231 | B1 | 3/2001 | Zafiroglu | |
| 6,272,701 | B1 | 8/2001 | Zafiroglu | |
| 6,883,193 | B2 | 4/2005 | Brooks et al. | |
| 7,240,383 | B2 | 7/2007 | Stewart | |
| 2008/0268734 | A1 * | 10/2008 | Tharpe et al. | 442/184 |

FOREIGN PATENT DOCUMENTS

| | | | |
|---|---|---|---|
| DE | 2829873 | A1 | 1/1980 |
| EP | 1849899 | A3 | 10/2007 |
| WO | 2006096567 | A1 | 9/2006 |

OTHER PUBLICATIONS

European Patent Office, European Search Report in corresponding EP Application Serial No. 09250160.0, issued May 25, 2009, 5 pages.

* cited by examiner

*Primary Examiner* — Fredrick Conley
(74) *Attorney, Agent, or Firm* — Wood, Herron & Evans, LLP

(57) ABSTRACT

A bed sheet defined by a one-ply woven web of warp yarns and fill yarns having a top and a side panel depending from the top panel. The warp yarns extend in a warp direction through the top and side panel and the fill yarns extend in a fill direction through the top and the side panel. A plurality of fill yarns, warp yarns, or both are a non-spandex, non-core spun elastomeric yarn whereby the bed sheet is stretchable at least along the elastomeric yarns as a contoured bed sheet. In one example, the non-spandex, non-core spun elastomeric yarns are composed of elasterell-p.

27 Claims, 3 Drawing Sheets

WOVEN CONTOURED BED SHEET WITH ELASTOMERIC YARNS

FIELD OF THE INVENTION

The present invention relates to bedding and, more particularly, to contoured or fitted bed sheets.

BACKGROUND OF THE INVENTION

Contoured or fitted bed sheets are typically made from either woven fabric or knitted fabric. Contoured fitted sheets made from woven fabric generally have no inherent ability to stretch and grab around the mattress and so are often finished with an elastic binding around the bottom edge of the sheet to assist in holding the sheet to the mattress. The elastic binding presents problems, especially in the hospitality and healthcare markets where they are handled in commercial laundry environments. The harsh laundering processes involved tends to shorten the life of the elastic thereby limiting the service life of the sheet. Further, each sheet is typically fitted to a mattress having a thickness related to the sidewall depth or height of the sheet, especially at the corners. But, there is little uniformity to mattress thicknesses across styles or manufacturers creating particular problems in facilities that have a lot of beds, as typical of health care facilities and hospitality properties. Additionally, some beds, especially in the health care environment, are adjustable. Non-stretchable woven contoured sheets tend to slip off the corners of mattresses as the ends of such beds are raised and/or lowered.

Knitted contoured bed sheets avoid some of these problems as they inherently stretch to fit and hold better to various thicknesses and adjusted positions of mattresses, without the need for an elastic binding. But, knit fabrics are typically less durable and have a less desirable hand than woven fabrics. Moreover, knitted fabrics are more complicated and costly to process in commercial laundry as they are not easily handled with ordinary flat work ironers or folding machinery common in commercial laundry settings. As a result, knitted sheets tend to require more manual handling, and thus increase processing costs as compared to woven fabrics. Further, laundry efficiency is generally reduced by the need to handle both woven and knitted fabrics. Also, hybrid products combining both woven and knit fabrics have been introduced, but are not sufficient to meet the demands of the health care and hospitality markets.

The hospitality market tends to prefer woven fabrics and the healthcare market, while accepting of knitted fabrics, could also benefit from woven fabrics. To that end, attempts have been made to add stretch and recovery characteristics to woven fabric without requiring elastic binding around the edge. One proposal is to include spandex yarns or core-spun yarns along with the traditional, typically non-elastic yarns. But results have been considered unsatisfactory. For example, spandex based yarns tend to become discolored and degrade when exposed to chlorine and heat, both commonly encountered in commercial laundry settings. Core-spun yarns are undesirable because they lack durability in the institutional wash process and they limit the ability to control the elastomeric content in the fabric. Another proposal has been to induce a stretch characteristic into the sheet by treatments that affect the sinuosity and crimp of the yarns. However, the treatment process undesirably increases cost and often involves chemicals considered harmful to workers and the environment.

SUMMARY OF THE INVENTION

The present invention provides a woven bed sheet that serves as a contoured or fitted bed sheet but without the above-discussed drawbacks. To that end and in accordance with the principles of the present invention, the bed sheet is defined by a one-ply woven web of warp and fill yarns in which a plurality of either the fill yarns or the warp yarns (or both) are non-spandex, non-core spun elastomeric yarns. The elastomeric yarns allow the sheet to stretch along the warp or fill direction of those yarns, i.e., along the length and/or width of the sheet. That woven sheet can be used as a contoured bed sheet with the benefits of woven sheets, such as desirable durability and hand along with acceptable laundry processing behavior, and with the benefits of knitted sheets such as the ability to fit different sized mattresses and to stay bound to the corners of mattresses as they are raised and lowered on adjustable beds, but without the discoloration and/or chemistry drawbacks of prior proposals to render woven sheets suitably elastic.

By virtue of the foregoing, there is thus provided a woven bed sheet that serves as a contoured or fitted bed sheet but without the above-discussed drawbacks. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and together with the general description of the invention given above and the detailed description of the embodiment given below, serve to explain the principles of the present invention.

DETAILED DESCRIPTION OF THE DRAWINGS

Figure 1:
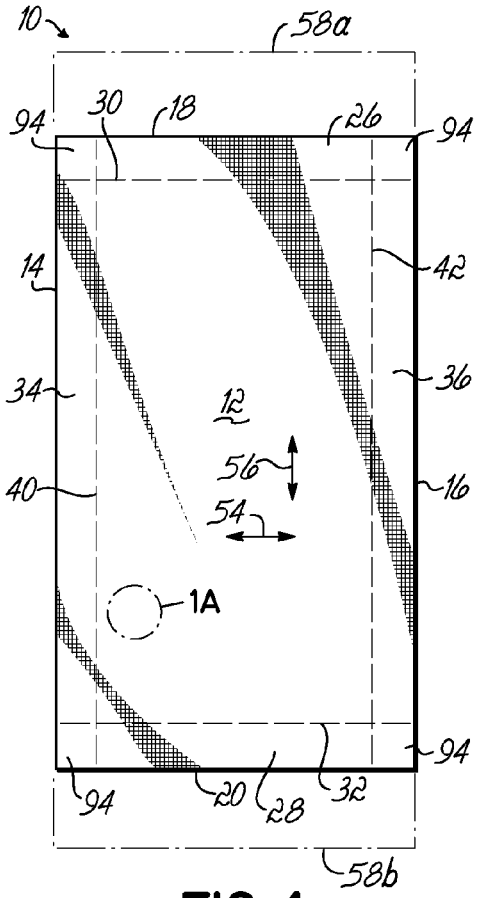
FIG. 1 is a top plan view of a length of woven fabric for use in making a contoured bed sheet in accordance with the principles of the present invention.
Figure 1A:
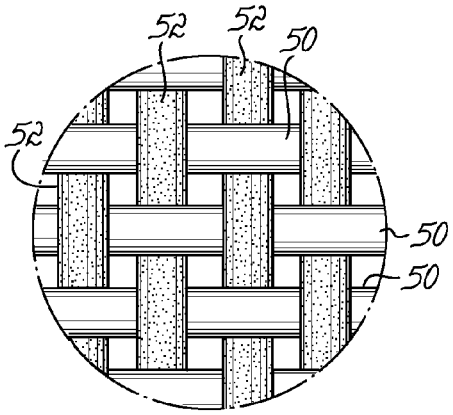
FIG. 1A is an enlarged, fragmentary top plan view, not to scale, of the woven fabric of FIG. 1.

With reference to FIGS. 1 and 1A, a rectangular length of woven fabric 10 has a field portion 12 extending widthwise between opposite left 14 and right 16 edges and lengthwise between opposite top 18 and bottom 20 edges. The field portion 12 has opposite widthwise top 26 and bottom 28 segments that extend between the top fold line 30 and the top edge 18 and the bottom fold line 32 and the bottom edge 20, respectively. The field portion 12 also has opposite lengthwise left 34 and right 36 segments that extend between the left fold line 40 and the left edge 14 and the right fold line 42 and the right edge 16, respectively. The woven fabric 10 is further defined by a one-ply woven web of warp yarns 50 and fill yarns 52. In particular, the length of woven fabric 10 has been originally woven and cut so that the warp yarns 50 define the widthwise direction 54 and the fill yarns 52 define the lengthwise direction 56 of woven fabric 10. Accordingly, the warp yarns 50 and fill yarns 52 extend through the woven fabric 10 in the widthwise direction 54 and the lengthwise direction 56, respectively. A plurality of the fill yarns 52 are non-spandex, non-core spun elastomeric yarns so that the woven fabric 10 is stretchable in the lengthwise direction 56, as indicated by dashed lines 58*a* and 58*b*.

In one example, substantially all, or all, fill yarns 52 are non-spandex, non-corespun elastomeric yarns. Advantageously, such fills yarns 52 include an elastic multifilament yarn, such as a bi-component polyester textile fiber. In one example, the bi-component polyester textile fiber is elasterell-p. The remaining yarns, including warp yarns 50, provide yarns other than non-spandex, non-corespun elastomeric yarns. In one example, the warp yarns 50 may include all or substantially all non-elastomeric yarns such as natural fibers, e.g., cotton fibers, synthetic fibers, e.g., polyester fibers, or combinations, and/or blends thereof. This elastomeric yarn fill/non-elastomeric yarn warp configuration is preferred because in industrial weaving the yarns in the warp are under tension, which is difficult to control with elastomeric yarns.

The non-spandex, non-corespun elastomeric yarns are woven into the woven fabric 10 in quantities sufficient to allow the field portion 12 to stretch in the lengthwise direction 56 such that the top 18 edge and bottom 20 edge extend along the elastomeric fill yarns 52 toward dashed lines 58*a* and 58*b*, respectively. In one embodiment, the non-spandex, non-corespun elastomeric fill yarns 52 include between about 5% to about 70% by weight of the woven fabric 10. In another embodiment, the non-spandex, non-corespun elastomeric fill yarns 52 include between about 10% to about 50% by weight of the woven fabric 10. In yet another embodiment, the non-spandex, non-corespun elastomeric fill yarns 52 include between about 15% to about 30% by weight of the woven fabric 10.

The woven fabric 10, in one embodiment, is stretchable in the lengthwise direction 56 in a range of about 2% to about 50% of its unstretched length. In another embodiment, the woven fabric 10 is stretchable in the lengthwise direction 56 in a range of about 5% to about 25% of its unstretched length.

Figure 2:
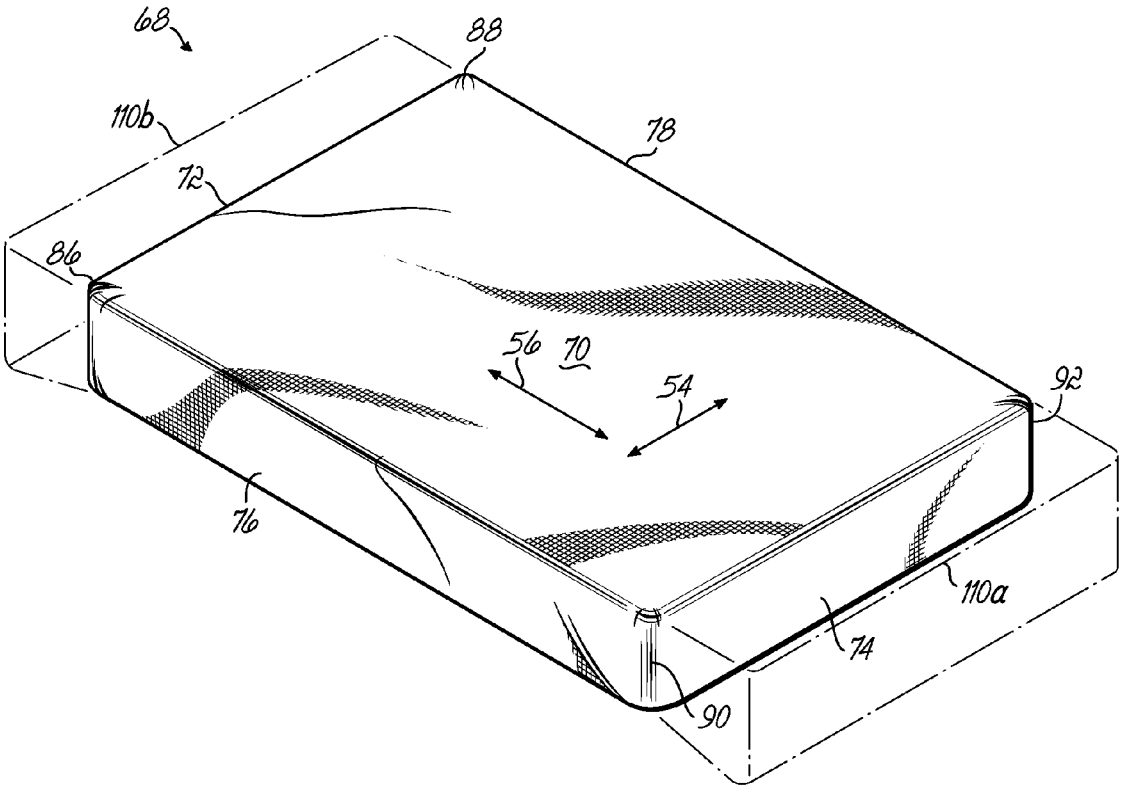
FIG. 2 is a perspective view of a contoured bed sheet formed from the woven fabric of FIG. 1.

With reference to FIG. 2, a contoured bed sheet 68, which is formed from the woven fabric of FIG. 1, is provided having a top panel 70 with opposite upper 72 and lower 74 side panels and opposite left 76 and right 78 side panels depending from the top panel 70. Accordingly, the warp yarns 50 of woven fabric 10 extend in a widthwise direction 54 through the top 70 and side 72, 74, 76, 78 panels and the fill yarns 52 extend in a lengthwise direction 56 through the top 70 and side panels 72, 74, 76, 78.

The upper side panel 72 of contoured bed sheet 68 extends between upper left 86 and upper right 88 corner pockets. The upper 72 side panel of FIG. 2 is formed by folding the top 26 segment of FIG. 1 at the top fold line 30 until the top 26 segment is about perpendicular with the top panel 70 of FIG. 2. Similarly, the lower panel 74 extends between the lower left 90 and lower right 92 corner pockets. The lower 74 side panel of FIG. 2 is formed by folding the bottom 28 segment of FIG. 1 at the bottom fold line 32 until the bottom 28 segment is about perpendicular with the top panel 70 of FIG. 2. The left side panel 76 extends between the upper left 86 and lower left 90 corner pockets. The left 76 side panel of FIG. 2 is formed by folding the left 34 segment of the woven fabric 10 of FIG. 1 at the left fold line 40 until the left 34 segment is about perpendicular with the top panel 70 of FIG. 2. Similarly, the right 78 side panel extends between the upper right 88 and lower right 92 corner pockets. The right 78 side panel of FIG. 2 is formed by folding the right 36 segment of the woven fabric 10 of FIG. 1 at the right fold line 42 until the right 36 segment is about perpendicular with the top panel 70 of FIG. 2.

The upper left 86 and upper right 88 corner pockets and lower left 90 and lower right 92 corner pockets of FIG. 2 are formed where the upper 72 and lower 74 side panels overlap with the left 76 and right 78 side panels. The corner pockets, 86, 88, 90, 92 can be formed by any method known to one having ordinary skill in the art such as, for example, by removing all or a portion of the corner segment 94, defined as the area where the top 26 and bottom 28 segments overlap with the left 34 and right 36 segments (See FIG. 1), and stitching the edges where the side panels 72, 74, 76, 78 come together or by folding the corner segments 94 and stitching the corner pockets 86, 88, 90, 92. One having ordinary skill in the art will appreciate that this method of making a contoured bed sheet from the woven fabric 10 can be modified to provide contoured bed sheets that fit irregularly shaped mattresses, such as, for example, a circular-shaped contoured bed sheet having a single continuous side panel to fit a circular mattress.

The contoured bed sheet 68 is stretchable in the lengthwise direction 56 across the top and side panels as indicated by dashed lines 110*a* and 110*b*. This is advantageous because commercial folders for woven bed sheeting, generally receive bed sheets widthwise rather than lengthwise. Indeed, because the elastomeric yarns extend along the length of the bed sheet, widthwise insertion into commercial folders prevents needless and excessive lengthwise stretching of the elastomeric yarns thereby preserving its stretch. Although the embodiment illustrated in FIG. 2 is a contoured bed sheet 68 that stretches along the fill yarns in the lengthwise direction, one of skill in the art will appreciate that woven fabric 10 can be woven and cut to make a contoured bed sheet with fill yarns 52 that stretch in the widthwise direction 54.

Figure 3:
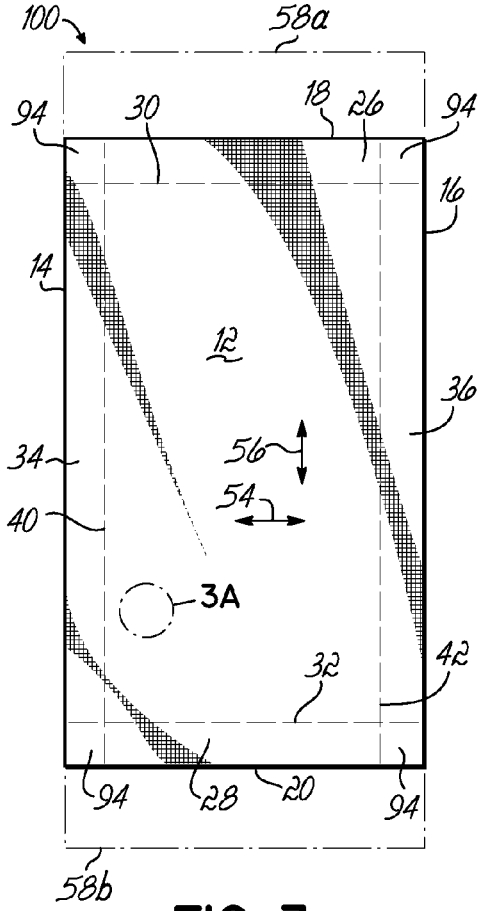
FIG. 3 is a top plan view of an alternate embodiment of a length of woven fabric for use in making a contoured bed sheet in accordance with the principles of the present invention.
Figure 3A:
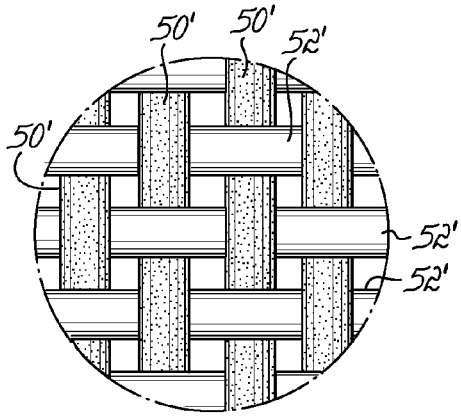
FIG. 3A is an enlarged, fragmentary top plan view, not to scale, of the woven fabric of FIG. 3.

With reference to FIGS. 3 and 3A, in an alternate embodiment, a rectangular length of woven fabric 100 likewise has a field portion 12 extending widthwise between opposite left 14 and right 16 edges and lengthwise between opposite top 18 and bottom 20 edges. The field portion 12 has opposite widthwise top 26 and bottom 28 segments that extend between the top fold line 30 and the top edge 18 and the bottom fold line 32 and the bottom edge 20, respectively. The field portion 12 also has opposite lengthwise left 34 and right 36 segments that extend between the left fold line 40 and the left edge 14 and the right fold line 42 and the right edge 16. The woven fabric 100 is further defined by a one-ply woven web of warp yarns 50' and fill yarns 52' woven together. In particular, the length of woven fabric 100 has been originally woven and cut so that the warp yarns 50' define the lengthwise direction 56 and the fill yarns 52' define the widthwise direction 54 of woven fabric 100. Accordingly, the warp yarns 50' and fill yarns 52' extend through the woven fabric 100 in the lengthwise direction 56 and the widthwise direction 54, respectively. A plurality of the warp yarns 50' are non-spandex, non-core spun elastomeric yarns so that the woven fabric 100 is stretchable in the lengthwise direction 56, as indicated by dashed lines 58*a* and 58*b*.

In one example, substantially all, or all, warp yarns 50' are non-spandex, non-corespun elastomeric yarns, as defined above. Advantageously, such warp yarns 50' include an elastic multifilament yarn, such as a bi-component polyester textile fiber. In one example, the bi-component polyester textile fiber is elasterell-p. The remaining yarns, including fill yarns 52', provide yarns other than non-spandex, non-corespun elastomeric yarns. In one example, the fill yarns 52' may include all or substantially all non-elastomeric yarns as described above.

The non-spandex, non-corespun elastomeric yarns are woven into the woven fabric 100 in quantities sufficient to allow the field portion 12 to stretch in the lengthwise direction 56 so that the top edge 18 and bottom edge 20 extend along the elastomeric warp yarns 50' toward dashed lines 58*a* and 58*b*, respectively. In one embodiment, the non-spandex, non-corespun elastomeric warp yarns 50' include between about 5% to about 70% by weight of the woven fabric 100. In another embodiment, the non-spandex, non-corespun elastomeric warp yarns 50' include between about 10% to about 50% by weight of the woven fabric 100. In yet another embodiment, the non-spandex, non-corespun elastomeric warp yarns 50' include between about 15% to about 30% by weight of the woven fabric 100.

The woven fabric 100, in one embodiment, is stretchable in the lengthwise direction 56 in a range of about 2% to about 50% of its unstretched length. In another embodiment, the woven fabric 100 is stretchable in the lengthwise direction 56 in a range of about 5% to about 25% of its unstretched length.

The woven fabric 100, may be used to form a contoured bed sheet similar in construction to contoured bed sheet 68 illustrated in FIG. 2 wherein the contoured bed sheet 68 stretches along non-spandex, non-corespun elastomeric warp yarns 50' in the lengthwise direction 56 across the top panel 70 and side panels 72, 74, 76, 78. In the alternative, one of skill in the art will appreciate that woven fabric 100 can be woven and cut to make a contoured bed sheet with warp yarns 50' making the top panel 70 and side panels 72, 74, 76, 78 of the contoured bed sheet 68 stretchable in the widthwise direction 54.

Figure 4:
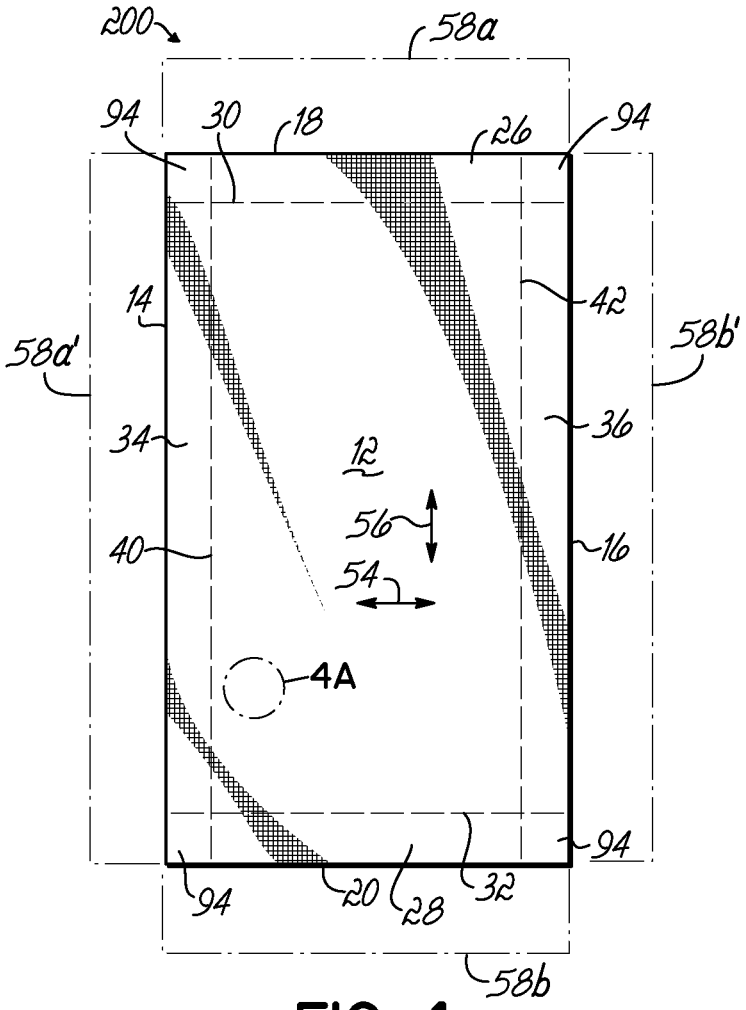
FIG. 4 is a top plan view of an alternate embodiment of a length of woven fabric for use in making a contoured bed sheet in accordance with the principles of the present invention.
Figure 4A:
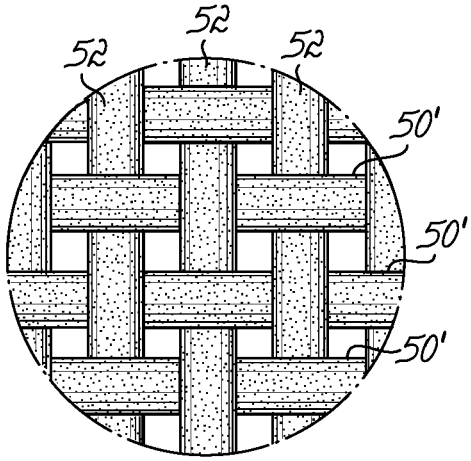
FIG. 4A is an enlarged, fragmentary top plan view, not to scale, of the woven fabric of FIG. 4.

With reference to FIGS. 4 and 4A, in an alternate embodiment, a rectangular length of woven fabric 200 likewise has a field portion 12 extending widthwise between opposite left 14 and right 16 edges and lengthwise between opposite top 18 and bottom 20 edges. The field portion 12 has opposite widthwise top 26 and bottom 28 segments that extend between the top fold line 30 and the top edge 18 and the bottom fold line 32 and the bottom edge 20, respectively. The field portion 12 also has opposite lengthwise left 34 and right 36 segments that extend between the left fold line 40 and the left edge 14 and the right fold line 42 and the right edge 16. The woven fabric 200 is further defined by a one-ply woven web of warp yarns 50' and fill yarns 52 woven together. In particular, the length of woven fabric 200 has been originally woven and cut so that the warp yarns 50' define the widthwise direction 54 and the fill yarns 52 define the lengthwise direction 56 of woven fabric 200. It will be appreciated that the length of woven fabric 200, alternately, may be cut so that the warp yarns 50' define the lengthwise direction 56 and the fill yarns 52 define the widthwise direction 54. Regardless, a plurality of the warp yarns 50' and fill yarns 52 are non-spandex, non-core spun elastomeric yarns so that the woven fabric 200 is stretchable in both the widthwise direction 54 and the lengthwise direction 56, as indicated by dashed lines 58*a*, 58*b*, 58*a'* and 58*b'*.

In one example, substantially all, or all, warp yarns 50' and fill yarns 52 are non-spandex, non-corespun elastomeric yarns as defined above. Advantageously, such warp yarns 50' and fill yarns 52 include an elastic multifilament yarn, such as a bi-component polyester textile fiber. In one example, the bi-component polyester textile fiber is elasterell-p. The remaining yarns provide yarns other than non-spandex, non-corespun elastomeric yarns.

The non-spandex, non-corespun elastomeric yarns are woven into the woven fabric 200 in quantities sufficient to allow the field portion 12 to stretch in both the widthwise direction 54 and the lengthwise direction 56. The fabric 200 stretches in the widthwise direction so that the left 14 edge and right 16 edge extend along the elastomeric warp yarns 50' toward dashed lines 58*a'* and 58*b'*, respectively. The fabric 200 also stretches in the lengthwise direction 56 so that the top edge 18 and bottom edge 20 extend along the elastomeric fill yarns 52 toward dashed lines 58*a* and 58*b*, respectively. In one embodiment, the non-spandex, non-corespun elastomeric yarns include between about 1% to about 100% by weight of the woven fabric 200. In another embodiment, the non-spandex, non-corespun elastomeric yarns include between about 10% to about 80% by weight of the woven fabric 200. In yet another embodiment, the non-spandex, non-corespun elastomeric yarns include between about 15% to about 60% by weight of the woven fabric 200.

The woven fabric 200, in one embodiment, is stretchable in both the widthwise direction 54 and lengthwise direction 56 in a range of about 2% to about 50% of its unstretched length. In another embodiment, the woven fabric 200 is stretchable in both the widthwise direction 54 and lengthwise direction in a range of about 5% to about 25% of its unstretched length.

Additionally, the woven fabric 200 may be used to form a contoured bed sheet similar in construction to contoured bed sheet 68 illustrated in FIG. 2. The contoured bed sheet 68 formed with woven fabric 200 stretches along non-spandex, non-corespun elastomeric yarns 50', 52 in the widthwise direction 54 and in the lengthwise direction across the top panel 70 and side panels 72, 74, 76, 78 as indicated by dashed lines 110*a,b* and 112*a,b*.

While FIGS. 1A, 3A, and 4A show the woven fabric 10, 100, 200 as having a 1×1 plain weave, one skilled in the art will appreciate that any weave pattern generally may be used, such as, for example, a twill or satin weave. Such woven fabric 10, 100, 200 can be woven using common weaving techniques as known to one having ordinary skill in the art. Various finishing treatments may be applied as desired to the woven fabric 10, 100, 200 used in the invention such as, for example, bleaching, dyeing, etc.

The bed sheet 68 may have additional finishing alterations such as, for example, providing a hem or binding of various types around the outer edge.

In use, the woven fabrics 10, 100, 200 are formed into contoured bed sheet 68 to stretch along the top surface and over the sides of a mattress so as to grip the underside of the mattress without requiring elastic binding along the hem of the contoured bed sheet 68. The resulting contoured bed sheet 68 provides the benefits of woven sheets, such as desirable durability and hand along with acceptable laundry processing behavior and with the benefits of knitted sheets such as the ability to fit different sized mattresses and to stay bound to the corners of mattresses as they are raised and lowered on adjustable beds, but without the discoloration and/or chemistry drawbacks of prior proposals to render woven sheets stretchable.

By virtue of the foregoing, there is thus provided a contoured bed sheet with the advantages of both woven and knitted sheets, but without some of the drawbacks.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. An important aspect of the invention is that the woven fabrics and contoured bed sheet consist of a one-ply woven fabric, which does not include woven fabrics having additional plies. Further, it is understood that while the contoured bed sheet no longer requires the use of an elastic binding or hem to grip the underside of a mattress, an elastic binding or hem may be added to the contoured bed sheet of the invention. In addition, consisting essentially of, as used herein, is understood not to exclude additional handling or finishing treatments as may be desirable for the woven fabrics and or contoured bed sheets of the invention such as, for example, dying and bleaching treatments, or other treatments that may affect the appearance, stretch characteristics, durability, or hand of the woven fabrics and or contoured bed sheet. The invention in its broader aspects is, therefore, not limited to the specific detail, representative apparatus and methods and illustrative examples shown and described. Accordingly, departures may be made from such details without departing from the spirit or scope of the general inventive concept.

What is claimed:

1. A textile article consisting essentially of a bed sheet defined by a one-ply woven web of warp yarns and fill yarns having a top panel and a side panel depending from the top panel, the warp yarns extending in a warp direction through the top panel and side panel and the fill yarns extending in a fill direction through the top panel and the side panel, a plurality of the fill yarns being a non-spandex, non-core spun elastomeric yarn whereby the bed sheet is stretchable at least along the elastomeric yarns as a contoured bed sheet.

2. The bed sheet of claim 1 wherein the elastomeric yarn includes an elastic, multifilament yarn.

3. The bed sheet of claim 1 wherein the elastomeric yarn includes a bi-component polyester textile fiber.

4. The bed sheet of claim 1 wherein the elastomeric yarn includes elasterell-p.

5. The bed sheet of claim 1 wherein at least one warp yarn includes a non-elastomeric yarn.

6. The bed sheet of claim 1 wherein the non-elastomeric yarn includes a natural fiber, a synthetic fiber, or combinations, and/or blends thereof.

7. The bed sheet of claim 1 wherein the fill direction of the woven fabric defines the length of the bed sheet.

8. The bed sheet of claim 1 wherein the elastomeric yarns comprise between about 5% to about 70% by weight of the bed sheet.

9. The bed sheet of claim 1 wherein the bed sheet is stretchable in the fill direction in a range of about 2% to about 50% of its unstretched length.

10. The bed sheet of claim 1 wherein substantially all fill yarns are elastomeric.

11. The bed sheet of claim 1 wherein the warp yarns are substantially void of elastomeric yarns.

12. A textile article consisting essentially of a bed sheet defined by a one-ply woven web of warp yarns and fill yarns having a top panel and a side panel depending from the top panel, the warp yarns extending in a warp direction through the top panel and side panel and the fill yarns extending in a fill direction through the top panel and the side panel, a plurality of warp yarns being a non-spandex, non-core spun elastomeric yarn whereby the bed sheet is stretchable at least along the elastomeric yarns as a contoured bed sheet.

13. The bed sheet of claim 12 wherein the elastomeric yarn includes an elastic, multifilament yarn.

14. The bed sheet of claim 12 wherein the elastomeric yarn includes a bi-component polyester textile fiber.

15. The bed sheet of claim 12 wherein the elastomeric yarn includes elasterell-p.

16. The bed sheet of claim 12 wherein at least one fill yarn includes a non-elastomeric yarn.

17. The bed sheet of claim 16 wherein the non-elastomeric yarn includes a natural fiber, a synthetic fiber, or combinations, and/or blends thereof.

18. The bed sheet of claim 12 wherein the warp direction of the woven fabric defines the length of the bed sheet.

19. The bed sheet of claim 12 wherein the elastomeric yarns comprise between about 5% to about 70% by weight of the bed sheet.

20. The bed sheet of claim 12 wherein the bed sheet is stretchable in the warp direction in a range of about 2% to about 50% of its unstretched length.

21. The bed sheet of claim 12 wherein substantially all warp yarns are elastomeric.

22. The bed sheet of claim 12 wherein the fill yarns are substantially void of elastomeric yarns.

23. A textile article consisting essentially of a bed sheet defined by a one-ply woven web of warp yarns and fill yarns having a top panel and a side panel depending from the top panel, the warp yarns extending in a warp direction through the top panel and side panel and the fill yarns extending in a fill direction through the top panel and the side panel, a plurality of warp yarns and fill yarns being a non-spandex, non-core spun elastomeric yarn whereby the bed sheet is stretchable at least along the elastomeric yarns as a contoured bed sheet.

24. The bed sheet of claim 23 wherein the elastomeric yarn includes elasterell-p.

25. The bed sheet of claim 23 wherein the fill direction of the woven fabric defines the length of the bed sheet.

26. The bed sheet of claim 23 wherein the elasterell-p yarns comprise between about 1% to about 100% by weight of the bed sheet.

27. The bed sheet of claim 23 wherein the bed sheet is stretchable in at least one direction in a range of about 2% to about 50% of its unstretched length.

* * * * *